United States Patent [19]

Baur

[11] 4,062,784

[45] Dec. 13, 1977

[54] OIL-IN-WATER EMULSION FOR COLD ROLLING

[75] Inventor: Rudolf Baur, Kreuzlingen, Switzerland

[73] Assignee: Swiss Aluminium Ltd., Chippis, Switzerland

[21] Appl. No.: 710,682

[22] Filed: Aug. 2, 1976

[30] Foreign Application Priority Data

Aug. 5, 1975 Switzerland ..... 10224/75

[51] Int. Cl.[2] ..... C10M 1/24; C10M 3/18; B21B 45/02

[52] U.S. Cl. ..... 252/49.5; 72/42; 252/56 R

[58] Field of Search ..... 252/56 R, 49.5; 72/42

[56] References Cited

U.S. PATENT DOCUMENTS

| | | | |
|---|---|---|---|
| 2,899,390 | 8/1959 | Plemich | 252/56 R |
| 3,507,792 | 4/1970 | Zuran | 252/49.5 |
| 3,923,671 | 12/1975 | Knepp | 252/49.5 |

FOREIGN PATENT DOCUMENTS

| | | | |
|---|---|---|---|
| 15,387 | 8/1967 | Japan | 252/56 R |

*Primary Examiner*—Allen B. Curtis
*Attorney, Agent, or Firm*—Ernest F. Marmorek

[57] ABSTRACT

The invention concerns an oil-in-water emulsion suitable for the cold rolling of light metals. The emulsion comprises from about 1 to about 5% by weight alkyl monocarboxylic acid ester, from about 0.5 to about 7% by weight polybutene, from about 0.5 to about 2% by weight polyethoxylated sorbitan oleate, from about 0.5 to about 2.5% by weight unsaturated long-chain alkyl monocarboxylic acid and from about 0.1 to about 2.5% by weight of hexamethylenetetramine in the oil phase, in deionized water.

13 Claims, No Drawings

OIL-IN-WATER EMULSION FOR COLD ROLLING

The invention relates to an oil-in-water emulsion for cold rolling light metals, especially aluminum. The term "aluminum" includes both pure aluminum and also aluminum based alloys.

Compared with oil-based roll lubricants, oil-in-water emulsions, because of the greater latent heat of vaporization of water, give a much greater cooling effect and thus a greater reduction per pass and/or an increased rolling speed. Besides these purely economic factors, which greatly assist rationalization, aqueous rolling also means greatly reduced waste gas problems and less dependency on natural oil. Therefore, in the light metal industries and especially in the aluminum industry, many experiments have already been undertaken to introduce oil-in-water emulsions in the cold rolling of strips.

Although numerous publications have appeared in this field, the lubricating mechanism of rolling with oil-in-water emulsions has not satisfactorily been recognized, and the published emulsions themselves have not found entrance into industrial practice.

The greatest disadvantage of known oil-in-water emulsions lies in the fact that, during the rolling process, the formation of hydrogen from water and aluminum cannot be prevented. The nascent hydrogen is taken up by the steel of the rollers, making the steel brittle. The surfaces of the steel rollers thus become fragile and are the no longer equal to the requirements of the rolling process. Repeated scaly fractures result and pieces from 1 $mm^2$ to 100 $cm^2$ in size crack off the hardened roller working surfaces.

These extremely undesirable scaly fractures, which appear regularly on working and supporting rollers after a short period of operation, i.e., a matter of hours or days, can only secondarily be attributed to insufficient lubrication.

It is therefore an object of the invention to provide an oil-in-water emulsion for the cold rolling of light metals, especially of aluminum, which has improved technological and economic properties, and does not have the above defects.

According to the invention 1000 parts by weight of such an emulsion comprises 10 to 50 parts by weight alkyl monocarboxylic acid ester, 5 to 70 parts by weight polybutenes, 5 to 20 parts by weight polyethoxylated sorbitan oleate, 5 to 25 parts by weight unsaturated long-chain alkyl monocarboxylic acids and 1 to 25 parts by weight hexamethylenetetramine in the oil phase, in a deionised water phase.

Very surprisingly, with the emulsion of the invention, the hydrogen embrittlement of steel rollers is not only significantly reduced, but substantially totally prevented. This means that the emulsion can be used successfully on an industrial scale, without hydrogen being produced tribo-chemically to cause the working rollers to become brittle, and thus interruptions in production and related disadvantages are minimized. The long-chain unsaturated acid acts as an inhibitor against hydrogen evolution, and oleic acid, linoleic acid and linolenic acid are preferred for this purpose. These acids are preferably introduced in an amount of from 8 to 20 parts by weight per 1000 parts by weight of emulsion. The following inhibitors have appeared to be inoperative: dicyclohexylamine, iso-propylaminoethanol, morpholine, imidazole, propargyl alcohol, hexamethyleneimine and sodium nitrite etc. Further, certain known inhibitors cannot operate in the emulsion, such as for example, dicyclohexylamine nitrite, 3,5-dinitrobenzoic acid, nicotinic acid, 3-hexene-1-ol and pelargonic acid, etc.

Oleic acid, linoleic acid and linolenic acid not only inhibit hydrogen evolution, but also exhibit excellent rust inhibition on the iron parts of the rolling mill and assist in forming reaction layers during the rolling deformation of aluminum strips which are being worked. In general, the long-chain unsaturated acid that is used will contain at least 10 and usually no more than 22 carbon atoms.

The polybutene constituent of the novel emulsion operates as a hydrodynamic agent which forms lubricating film. Preferably, in order to minimize loss of reduction in thickness of a strip when rolled using the emulsion, polyisobutylenes having mean molecular weights, determined by osmometric measurements, of about 200 to 600, e.g., 460 (Indopol H 100) and 320 (Indopol L 10), are used, or mixtures thereof. Preferably in doing this 9 to 70 parts, more preferably 15 to 27 parts, by weight of 460 m.wt. polyisobutylenes and/or 5 to 40 parts, more preferably 15 to 15 parts, by weight of 320 m.wt. polyisobutylenes are introduced per 1000 parts by weight emulsion.

If the polybutene content is too low, hydrogen evolution occurs during the rolling with the cold rolling emulsion. With too high a polybutene content, the cold rolling emulsion becomes unstable and separates into supernatant organic phase and an aqueous phase. However, because of the formation of a film by the organic phase containing polybutylene, rust formation on the steel rollers is hindered and no additional rust inhibitor, which could be exhausted in a short time, need be added.

The alkyl monocarboxylic acid esters which are used in the invention form a reaction layer. For this purpose, the acid portion of the ester is preferably of up to 16 carbon atoms, with the ester portion being of up to 12 carbon atoms. Butyl laurate, especially lauric acid n-butyl ester, is preferred, and this is most desirably introduced in a quantity of from 15 to 30 parts by weight per 1000 parts by weight of emulsion.

If, in place of butyl laurate, the emulsion is made up with another agent which can form a reaction layer, e.g., butyl stearate, lauryl alcohol or butanediol, then, during rolling of an aluminum strip with such an emulsion (which is not of the invention), a significant loss of reduction in thickness is observed. Moreover, there is often a reduction in surface quality.

The polyethoxylated sorbitan oleates which are added as emulsifiers are advantageously commercially available products, such as sorbitol polyoxyethylene hexaoleate (MULGOVEN VN 430), polyoxyethylated sorbitan esters of a mixture of fatty and resin acids (G 3936 CT), or polyoxyethylene sorbitan monooleate (TWEEN 81). These commercial products, of which the first is made by GAF, and the two others by Atlas-Chemie, are preferably added in a concentration of from 10 to 20 parts by weight per 1000 parts by weight of the emulsion.

If an emulsifier is chosen for the preparation of the emulsion which is not a polyethoxylated sorbitan oleate then in rolling, despite the presence of a hydrogen inhibitor such as oleic acid, hydrogen separates from the water of the emulsion in the roll nip during the deformation process, and can cause steel rollers to become brittle.

Hexamethylenetetramine (or Urotropin), which is added as a buffering agent and which is advantageously present in a concentration of 5 to 20 parts by weight per 1000 parts by weight of the deionized water emulsion, acts as a stabilizer for the cold roller emulsion and fixes the pH value of the emulsion by the hydrolysis equilibrium:

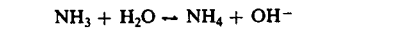

$$C_6H_{12}N_4 + 12H_2O \rightleftharpoons 6CH_2(OH)_2 + 4NH_3$$

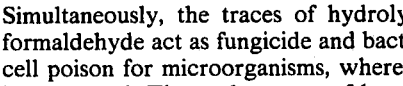

$$NH_3 + H_2O \rightleftharpoons NH_4 + OH^-$$

Simultaneously, the traces of hydrolytically released formaldehyde act as fungicide and bacteriocide, or as a cell poison for microorganisms, whereby the emulsion is conserved. The replacement of hexamethylenetetramine by other buffer systems, in particular by inorganic buffer systems (borate buffer, phosphate buffer, etc.) can lead to instability for the cold roller emulsion and to hydrogen evolution during the roller deformation. Similarly undesirable results can be observed with organic stabilizers such as polyvinylpyrrolidenes, copolymers of methylvinylether and oleic anhydride, etc.

It is necessary to clean the rolling aid while rolling aluminum because the abrasive wear of the aluminum gives dust which appears as finely divided particles in the rolling aid. This dirtying of the rolling aid is usually reckoned as oxide ash content. The ash residue is a measure of the dirtiness of the emulsion. The oxide ash content of a freshly prepared emulsion of the invention is about 0.0002% by weight. This emulsion can be used without cleaning until the oxide ash content of about 0.045% by weight is reached, which corresponds to a throughput of about 210 $m^2$ of aluminum surface per liter of emulsion.

When an oxide ash content of about 0.045% by weight is reached, the dust, together with a part of the oil phase of the emulsion, is separated automatically. A small quantity of the oil phase, which contains all the fines then floats on the emulsion. This part of the oil is known as coalescence. This coalescence is removed from the surface of the emulsion in the reservoir in the cold rolling emulsion circuit by using a skimmer or a suction device, and is collected and then separated by means of a disc centrifuge from any water. The dewatered oil phase is then separated from the fines in a chamber centrifuge. The clear oil phase is then returned to the cold rolling emulsion circuit, using an emulsifying machine. By this method, an oxide ash level of 0.04 to 0.05% by weight can be maintained in the emulsion over a long period. On rolling with emulsions regenerated in this way, high reductions per pass with good aluminum surface quality can be obtained.

The cold rolling emulsion can be monitored analytically, in that the components, apart from hexamethylenetetramine and aluminum fines, can be separated on silica gel using thin layer chromatography, and can then be simply measured, semi-quantitatively. Hexamethylenetetramine can be measured acidimetrically in the water phase, after the oil phase has been removed for measurement of the entire oil content, using sodium sulphate at about 80° C. The measurement of the abraded aluminum fines takes place in the calculation of the oxide ash content of the emulsion.

To make the cold rolling emulsion, the organic components are mixed in any sequence, suitably at room temperature, with simple stirring. This organic phase is worked up into an emulsion together with water in an emulsifying machine. The emulsion can be stored for a very long time and it can be kept in containers of all usual materials. Thanks to the hexamethylenetetramine acting not only as a stabilizer but also as a fungicide and a bacteriocide, there is no growth either of yeast nor of undesirable bacteria.

Before use, the emulsion is preferably heated to the temperature of the cold rolling station.

In the emulsions of the invention, there are no natural oils. Within the limits given, the chemical composition of the individual components can be varied, without the quality of the emulsion suffering.

With an experimental rolling mill, and using the emulsion of the invention, 330,000 $m^2$ of foil was rolled with only one pair of rollers, without the rollers being damaged in any way. In further operating experiments, in which about 1,000,000 $m^2$ of foil were rolled, the behavior of the rolls was normal.

In all experiments, in comparison with known emulsions, surprisingly high reductions per pass, e.g., up to 90%, are achieved. This high reduction makes power requirements when using the novel emulsion scarcely higher than with the lower reductions per pass which are achieved with other lubricants. For example, in U.S. Pat. Spec. No. 3,192,758, for unspecified oil-in-water emulsions, reductions per pass of 24 to 58% are given.

Strips and foils which have been rolled with the emulsion of the invention show good annealing characteristics in subsequent heat treatment, i.e., annealing without flaws is possible. The kinematic viscosity of the organic phase can easily be controlled, and can be varied without influencing the annealing properties.

The destruction of spent emulsions is relatively easy. They can simply be mixed with about 2 grams of calcium chloride per liter of emulsion, and stirred. The higher the temperature at which the emulsion is held in the separating vessel, the quicker the emulsion separates into an oil phase and an aqueous phase.

The emulsions of the invention are very desirable from an environmental viewpoint since, during the rolling process, only water vapor escapes. This is ecologically harmless, and the organic substances scarcely vaporize at all.

Moreover, from the economic viewpoint the emulsion is advantageous since its cost price is comparable with that of petrol-based cold rolling media. On the other hand, with the novel emulsions, greater reductions per pass can be achieved with equal or lesser expenditure of energy.

The following Examples illustrate emulsions of the invention and the results in reductions per pass which were achieved with cold rolling processes on aluminum strips, using a single rolling station with two working and two support rolls.

EXAMPLE 1

A cold rolling emulsion was made up from the following organic components, which were mixed at room temperature, with stirring:

| | |
|---|---|
| Butyl laurate | 25 parts by weight |
| Indopol H 100 | 15 parts by weight |
| Indopol L 10 | 10 parts by weight |
| Mulgoven VN 430 | 10 parts by weight |
| Oleic acid | 10 parts by weight |
| Hexamethylenetetramine | 10 parts by weight |

The 80 parts by weight of organic phase were mixed with 920 parts by weight of deionized water. The two separate phases were worked up in an emulsifying machine, into an emulsion, which has the following physico-chemical properties:

| | |
|---|---|
| pH value at 60° C | 6.80 |
| Conductivity at 60° C | 1.4 mS |
| Separable oil phase | 6.75% |
| Kinematic viscosity of the emulsion at 60° C | 0.733 cSt |
| Kinematic viscosity of the oil phase at 60° C | 10.93 cSt |
| Oxide ash content of the emulsion | 0.0001% |

With this cold rolling emulsion, the behavior of the rolls was tested with the following reduction per pass (all thicknesses in mm).

| Experiment No. | Metal | Starting thickness | Thickness after 1st pass | Thickness after 2nd pass | Thickness after 3rd pass |
|---|---|---|---|---|---|
| 1 | Al 99.5 | 0.700 | 0.160 | 0.050 | |
| 2 | Al 99.5 | 0.700 | 0.120 | 0.040 | |
| 3 | Al 99.5 | 0.330 | 0.075 | 0.027 | |
| 4 | Al 98.7 | 0.700 | 0.135 | 0.050 | |
| 5 | Al 98.7 | 0.700 | 0.160 | 0.075 | 0.035 |
| 6 | Al 98.7 | 0.700 | 0.090 | | |

In all the rolled strips the surface was of outstanding quality.

EXAMPLE 2

A cold rolling emulsion with the following organic components:

| | |
|---|---|
| Butyl laurate | 25 parts by weight |
| Indopol H 100 | 27 parts by weight |
| Indopol L 10 | 18 parts by weight |
| Mulgoven VN 430 | 10 parts by weight |
| Oleic acid | 10 parts by weight |
| Hexamethylenetetramine | 10 parts by weight |

was produced as in Example 1. It has the following physico-chemical properties:

| | |
|---|---|
| pH value at 60° C | 6.20 |
| Conductivity at 60° C | 1.8 mS |
| Separable oil phase | 9.0% |
| Kinematic viscosity of the emulsion at 60° C | 0.761 cSt |
| Kinematic viscosity of the oil phase at 60° C | 19 cSt |
| Oxid ash content of the emulsion | 0.002 |

The cold rolling emulsion exhibited the roll behavior set out below (all thicknesses in mm).

| Experiment No. | Metal | Starting thickness | Thickness after 1st pass | Thickness after 2nd pass | Thickness after 3rd pass |
|---|---|---|---|---|---|
| 1 | Al 99.5 | 0.700 | 0.100 | 0.024 | |
| 2 | Al 99.5 | 0.200 | 0.060 | 0.024 | |
| 3 | Al 99.5 | 0.700 | 0.200 | 0.050 | 0.025 |
| 4 | Al 99.5 | 0.700 | 0.140 | 0.060 | 0.023 |

-continued

| Experiment No. | Metal | Starting thickness | Thickness after 1st pass | Thickness after 2nd pass | Thickness after 3rd pass |
|---|---|---|---|---|---|
| 5 | Al 99.5 | 0.700 | 0.140 | 0.025 | |
| 6 | Al 98.7 | 0.700 | 0.110 | 0.027 | |

All the rolled aluminum strips had an excellent surface quality.

I claim:

1. An oil-in-water emulsion suitable for the cold rolling of light metals, which comprises from about 1 to about 5% by weight alkyl monocarboxylic acid ester capable of forming a reaction layer during the rolling deformation of said metals from about 0.5 to about 7% by weight polybutene, from about 0.5 to about 2% by weight polyethoxylated sorbitan oleate, from about 0.5 to about 2.5% by weight unsaturated long-chain alkyl monocarboxylic acid capable of inhibiting hydrogen evolution and from about 0.1 to about 2.5% by weight of hexamethylenetetramine in the oil phase, in deionized water.

2. An emulsion according to claim 1 in which the alkyl monocarboxylic acid ester is butyl laurate.

3. An emulsion according to claim 2 which comprises from 1.5 to 3% by weight of butyl laurate.

4. An emulsion according to claim 1 which comprises, as the polybutene, from 0.9 to 7% by weight of a polyisobutylene having an osmometrically calculated molecular weight of about 460 and/or from 0.5 to 4% by weight of a polyisobutylene having an osmometrically calculated molecular weight of about 320.

5. An emulsion according to claim 4 which comprises from 1.5 to 2.7% by weight of the polyisobutylene whose molecular weight is about 460 and/or from 1 to 1.5% by weight of polyisobutylene whose molecular weight is about 320.

6. An emulsion according to claim 1 in which the polyethoxylated sorbitan oleate is selected from the group consisting of sorbitol polyoxyethylene hexaoleate, polyoxyethylene sorbitan monooleate and polyoxyethylated sorbitan esters of a mixture of fatty and resin acids, and mixtures thereof.

7. An emulsion according to claim 6 which comprises from 1 to 2% by weight of the polyethoxylated sorbitan oleate.

8. An emulsion according to claim 1 in which the unsaturated long-chain alkyl monocarboxylic acid is selected from the group consisting of oleic acid, linoleic acid and linolenic acid, and mixtures thereof.

9. An emulsion according to claim 8 which comprises from 0.8 to 2% by weight of the unsaturated long chain alkyl monocarboxylic acid.

10. An emulsion according to claim 1 which comprises from 0.5 to 2% by weight of hexamethylenetetramine.

11. An emulsion according to claim 1 in which said alkyl monocarboxylic acid ester contains up to 16 carbon atoms in the acid moiety.

12. An emulsion according to claim 1 in which said alkyl monocarboxylic acid ester contains up to 16 carbon atoms in the acid moiety and up to 12 carbon atoms in the ester moiety.

13. An emulsion according to claim 1 in which said long-chain unsaturated alkyl monocarboxylic acid contains from 10 to 22 carbon atoms.

* * * * *